US011344092B2

(12) United States Patent
Dubois et al.

(10) Patent No.: US 11,344,092 B2
(45) Date of Patent: May 31, 2022

(54) FLEXIBLE AND TRANSPARENT MODULAR PACK AND CARRIER

(71) Applicants: Jean Dubois, Austin, TX (US); Craig Dubois, Austin, TX (US); Nicole Dubois, Austin, TX (US); Nicholas Ryan Dubois, Austin, TX (US)

(72) Inventors: Jean Dubois, Austin, TX (US); Craig Dubois, Austin, TX (US); Nicole Dubois, Austin, TX (US); Nicholas Ryan Dubois, Austin, TX (US)

( * ) Notice: Subject to any disclaimer, the term of this patent is extended or adjusted under 35 U.S.C. 154(b) by 130 days.

(21) Appl. No.: 15/503,931

(22) PCT Filed: Aug. 15, 2015

(86) PCT No.: PCT/US2015/045428
§ 371 (c)(1),
(2) Date: Feb. 14, 2017

(87) PCT Pub. No.: WO2016/028651
PCT Pub. Date: Feb. 25, 2016

(65) Prior Publication Data

US 2017/0238667 A1 Aug. 24, 2017

Related U.S. Application Data

(60) Provisional application No. 62/070,132, filed on Aug. 16, 2014.

(51) Int. Cl.
*B65D 85/18* (2006.01)
*A45C 11/26* (2006.01)
(Continued)

(52) U.S. Cl.
CPC ..... *A45C 11/26* (2013.01); *A45C 3/00* (2013.01); *A45C 3/004* (2013.01); *A45C 7/00* (2013.01); *A45C 13/03* (2013.01); *A45C 13/10* (2013.01); *A45F 3/02* (2013.01); *B65B 61/14* (2013.01); *B65B 63/045* (2013.01); *A45C 2007/0004* (2013.01); *A45C 2013/026* (2013.01)

(58) Field of Classification Search
CPC .. A45C 3/00; A45C 3/004; A45C 7/00; A45C 11/26; A45C 13/03; A45C 13/10
USPC ..... 206/278, 292, 297; 229/87.15; 211/113
See application file for complete search history.

(56) References Cited

U.S. PATENT DOCUMENTS 485,509 A 11/1892 Speed
1,604,090 A 10/1926 Wolfson
(Continued)

*Primary Examiner* — Luan K Bui
(74) *Attorney, Agent, or Firm* — The Law Firm of H. Dale Langley, Jr. P.C.

(57) ABSTRACT

A clothing carrier includes a flexible and transparent base sheet, said base sheet has multiple sets of opposing horizontal flaps, flexible and transparent vertical flaps attached to or integral with the main body of said base sheet, multiple detachable flap attachments configured such that said horizontal flaps and said vertical flap can be configured to form a series of clothing compartments, and a Swiss roll fastening mechanism. The carrier is adapted to be rolled from the unrolled configuration into a rolled configuration and fastened in the rolled configuration using the Swiss roll fastening mechanism. In alternatives, the carrier may be folded in a flip-flap/Z-fold configuration and secured by fastening mechanism in such configuration.

3 Claims, 7 Drawing Sheets

(51) Int. Cl.

| | |
|---|---|
| ***A45C 7/00*** | (2006.01) |
| ***A45C 3/00*** | (2006.01) |
| ***A45C 13/03*** | (2006.01) |
| ***A45C 13/10*** | (2006.01) |
| ***A45F 3/02*** | (2006.01) |
| ***B65B 61/14*** | (2006.01) |
| ***B65B 63/04*** | (2006.01) |
| *A45C 13/02* | (2006.01) |

(56) References Cited

U.S. PATENT DOCUMENTS 1,720,679 A * 7/1929 Karn ..... B65D 85/182 206/295
2,175,387 A * 10/1939 Goding ..... A47G 25/54 206/280
2,320,018 A * 5/1943 Ullman ..... B65D 5/18 206/297
2,502,033 A 3/1950 Bohn
3,024,824 A 3/1962 Bass
3,777,862 A 12/1973 Zipper
4,078,656 A * 3/1978 Crane ..... A61B 10/0096 206/223
4,562,952 A * 1/1986 Chinman ..... A45C 3/00 206/292
289,228 A 4/1987 Chinman
4,881,684 A * 11/1989 Chinman ..... A45C 3/00 190/115
4,967,986 A * 11/1990 Schildkraut ..... A45C 3/10 224/223
5,219,071 A * 6/1993 Knapp ..... A45C 11/16 206/479
5,337,896 A * 8/1994 Levy ..... A61B 10/0096 206/456
5,887,711 A 3/1999 McAuliffe
6,076,666 A 6/2000 Santa-Maria
6,237,761 B1 5/2001 Godshaw et al.
6,457,635 B1 * 10/2002 Scicluna ..... A45C 13/03 206/278
6,668,990 B2 12/2003 Humiston
8,376,102 B2 2/2013 Ritschel
8,511,466 B1 8/2013 Harris
8,991,597 B2 3/2015 Webb
9,565,914 B1 * 2/2017 Marraccini ..... A45C 13/02
2005/0006444 A1 1/2005 Ronen
2007/0272636 A1 * 11/2007 Hale ..... B65D 21/0204 211/113
2010/0089778 A1 * 4/2010 Park ..... A45C 7/0095 206/320
2011/0110614 A1 5/2011 Hecht
2012/0048668 A1 3/2012 Kelly
2014/0008252 A1 1/2014 Grey

* cited by examiner

Top of A (260) attaches to bottom of B (240) and B (260) to C (240)

FLEXIBLE AND TRANSPARENT MODULAR PACK AND CARRIER

TECHNICAL FIELD

The invention generally relates to packaging, and more particularly relates to systems and methods for packing and carriage of clothes and other items to minimize wrinkles, save space and view contents without opening.

BACKGROUND

Packing clothes for trips can be a difficult process since simply putting the clothes in a traditional suitcase can result in a number of unwanted problems. Clothes often end up wrinkled if simply placed in a suitcase because the clothes are free to move around largely unfettered within the case. This may result in creasing and wrinkling of the clothes on arrival at a destination.

Moreover, it may be difficult to fit in a suitcase all one's clothes and accessories. These items may be difficult to pack/compress in manner to avoid unwanted creases or wrinkles.

Further, in the present security environment related to travel, security agents (e.g. the TSA in the United States) often open suitcases and inspect through the clothing inside, in order to search for prohibited items. This searching process can further result in wrinkled clothes. It also leads to privacy and contamination concerns.

SUMMARY

A packing apparatus helps reduce wrinkling of clothes. Such an apparatus can allow more clothes to be packed in the same amount of space. The apparatus provides significant compression of items. The apparatus can be used as a garment carrier that can be carried as a standalone clothes carrier, and also can be inserted as a packing apparatus into a larger suitcase. The apparatus may be a single unit or multiple connected modules of packing setups. During packing and at final destination, the apparatus may include a modular element that allows it to function as a garment bag for hanging vertically from a hook or clothes hanger while allowing full visual inspection of the contents. Such an apparatus allows security agents to view clothes inside of the apparatus, such that security agents and the like may be less likely to handle and unpack the clothes. Absent such riffling by security agents and the like, there may be less chance of cross contamination of bacterial and/or environmental contaminants.

An embodiment of the invention is a system for packing. The system includes a backing, a base flap connected to the backing for folding against the backing, a left side flap connected to the backing, for folding against the base flap when folded against the backing, and a right side flap connected to the backing, for folding against the left side flap when folded against the base flap. It may, in alternatives, include a top flap that folds downward over the other segments.

In further aspects, the backing provides more than one compartment each formed of the base flap, the left side flap and the right side flap. In certain aspects, the more than one compartment is capable of allowing/creating a variable volume compartment.

In other aspect, the system includes a connector fixed to a side of the base flap opposing the backing when the base flap is folded against the backing, and a mating connector fixed to a side of the left side flap for attachment to the connector when the left side flap is folded against the base flap.

In further aspects, the system includes a second connector fixed to another side of the left side flap and a second mating connector fixed to a side of the right side flap for attachment to the second connector when the right side flap is folded against the left side flap.

In yet other aspects, the backing, together with the base flap, the right side flap, and the left side flap, as each folded, forms a pocket for containing an article.

In other aspects, the backing provides more than one unit of the base flap, the left side flap and the right side flap, for forming respective pockets for containing respective articles.

In further aspects, the backing, with respective pockets containing articles, is rollable. In alternatives, the backing, with respective pockets containing articles, may be flip-flap folded or Z-flap folded.

In even further aspects, the backing, the base flap, the left side flap, the right side flap, are each translucent to allow viewing.

In other aspects, the system includes a shoulder strap rolled into the backing, the shoulder strap provides a handle for carrying the backing as rolled.

Another embodiment of the invention is a method for packing. The method includes providing a rollable backing with at least one compartment each for an article storage.

In further aspects, the method includes providing each of the at least one compartment with a base flap, left flap and right flap, each flap is foldable towards the backing.

In yet further aspects, the method includes placing an article against the backing, between the base flap, the left flap, and the right flap, folding the base flap against the article and backing, folding the left flap against the base flap, and folding the right flap against the left flap.

In other aspects, the method includes repeating the steps of placing, folding the base flap, folding the left flap, and folding the right flap for each of the at least one compartment.

In further aspects, the method includes rolling the backing upon completion of the steps of placing, folding the base flap, folding the left flap, and folding the right flap for each of the at least one compartment, to retain each article in the roll.

In even further aspects, the method includes placing a strap against the backing prior to the step of rolling, to form a handle of the strap upon the step of rolling.

Yet another embodiment of the invention is a clothing carrier. The carrier includes a flexible and transparent base sheet, said base sheet having multiple sets of opposing horizontal flaps, flexible and transparent vertical flaps attached to or integral with the main body of said base sheet, multiple detachable flap attachment means configured such that said horizontal flaps and said vertical flap can be configured to form a series of clothing compartments, and a Swiss roll fastening mechanism. The carrier is adapted to be rolled from the unrolled configuration into a rolled configuration and fastened in the rolled configuration using the Swiss roll fastening mechanism. In certain alternatives, the system is adapted to be flip-flap folded or Z-folded and has a fastening mechanism.

BRIEF DESCRIPTION OF THE DRAWINGS

The present invention is illustrated by way of example and not limitation in the accompanying figures, in which like references indicate similar elements, and in which.

DETAILED DESCRIPTION

The following description refers to certain specific embodiments; however, the specific embodiments are merely illustrative and variations and changes may be made in the embodiments without diverting from the broad scope encompassed by the disclosure.

Figure 6:
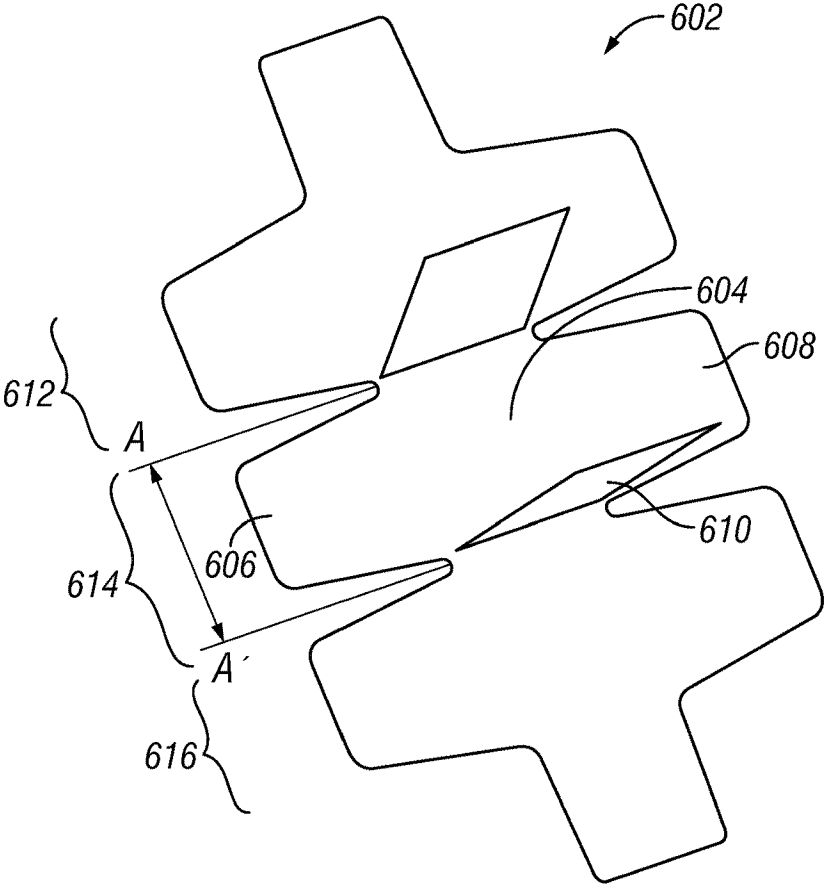
FIG. 6 illustrates a perspective view of a top side of a packing system, according to certain embodiments.

Referring to FIG. 6, a system 602 includes a backing 604. The backing 604 is formed or configured with, or connected to, side flaps, such as, for non-exclusive example, the left side flap 606 and the right side flap 608. Between the left side flap 606 and the right side flap 608, the backing 604 is formed or configured with, or connected to, a base flap 610.

The backing 604, as well as the left side flap 606 and the right side flap 608, may formed of a flexible or other material such that the left side flap 606 and the right side flap 608 are foldable against the backing 604. According to certain embodiments, the backing 604, the left side flap 606 and the right side flap 608, or certain of them, may be any of a transparent, translucent or see through material, such as, for example, polyethylene, polyvinylchloride, polyvinylidene chloride, or similar clear or semi-clear material, or a mesh, webbing or perforated material, or any combination. In the embodiments, the base flap 610, the left side flap 606, the right side flap 608 are foldable along edges where attached to the backing 604, towards the backing 604.

Although not shown in detail in FIG. 6, each of the base flap 610, the left side flap 606 and the bottom flap 608 may include connectors to removably join, when in folded configuration, the base flap 610 to the left side flap 606 and the right side flap to the left side flap 606. The connectors may be disposed on applicable surfaces of the respective flaps 610, 606, 608, for forming a pocket to contain an article, as non-exclusive example, an item of clothing, an accessory, or other. Connectors may include, but are not limited to, snaps, hooks, hook-and-loop, buttons, zipper, compression fit, magnets, static attraction or otherwise. In certain embodiments, the pocket so formed may be of non-fixed, poly-variable volume.

As shown in FIG. 6, the system 602 may include three compartments 612, 614, 616, each form of base flap, left side flap and right side flap. Although three compartments 612, 614, 616 are illustrated, any one or more compartments are possible in the embodiments. The backing 604, as well as the left side flap(s), right side flap(s), and base flap(s) may be of varied size in order to accommodate desired articles, for example, clothing, accessories or other items.

Figure 7:
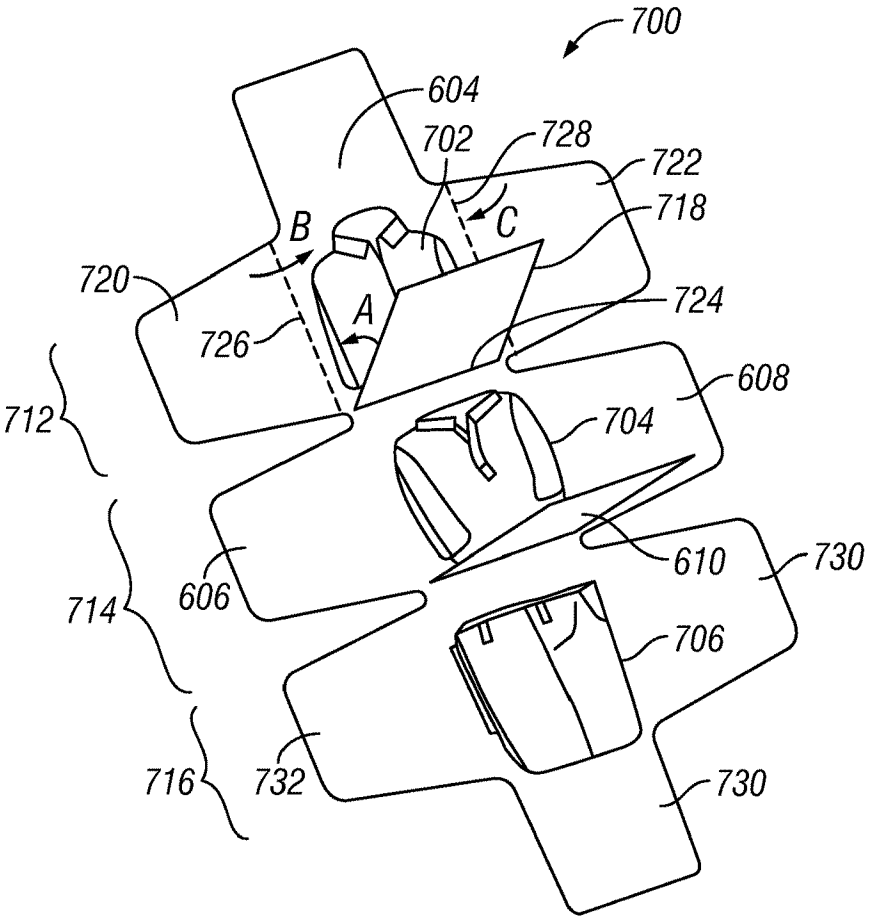
FIG. 7 illustrates a perspective view of a top side of a packing system during use, according to certain embodiments.

Referring to FIG. 7, in conjunction with FIG. 6, a system 700, for example, the system 600 of FIG. 6, is used to contain articles of clothing, for non-exclusive example, a collared shirt 702, a polo shirt 704, and pants 706. The system 700, like that of the system 600 of FIG. 6, forms three compartments 712, 714, 716. A first compartment 712 includes a first base flap 718, a first left side flap 720, and a first right side flap 722, each foldable against the backing 604 as illustrated by arrows A, B, and C.

In use, the first base flap 718 is folded (A) towards the backing 604 along an edge 724 of connection of the first base flap 718 to the backing 604. The first left side flap 720 is folded (B) towards the backing 604 along an edge 726 (in phantom) of connection of the first left side flap 720 to the backing 604. The first right side flap 722 is similarly folded (C) towards the backing 604 along an edge 728 (in phantom) of connection of the first right side flap 722 to the backing 604.

A second compartment 614 of the system 700 is like that of the system 600 of FIG. 6, including the base flap 610, the left side flap 606 and the right side flap 608 connected to the backing 604. In use, the base flap 610 is folded (as with the flap 718) towards the backing 604, the left side flap 606 is folded (as with flap 720) towards the backing 604, and the right side flap 608 is folded (as with flap 722) towards the backing 604. As so folded, the flaps 610, 606, 608 touch in order of the base flap 610, the left side flap 606, and the right side flap 608. As mentioned, the flaps 610, 606, 608 may include connectors to removably join respective surfaces of the flaps 610, 606, 608 where they touch in layers in such folded configuration. The folded flaps 610, 606, 608, together with the backing 604, form a pocket of the compartment 714.

A third compartment 716 of the system 700, similarly is formed of the backing 604, together with a third base flap 730, a third left side flap 732, and a third right side flap 734. When the flaps 730, 732 and 734 are folded towards the backing 604, in manner similar to that of with the flaps 718, 720, and 718 of the first compartment 712, the folded flaps 730, 732, 734, together with the backing 604, for a pocket of the compartment 716.

Figure 8:
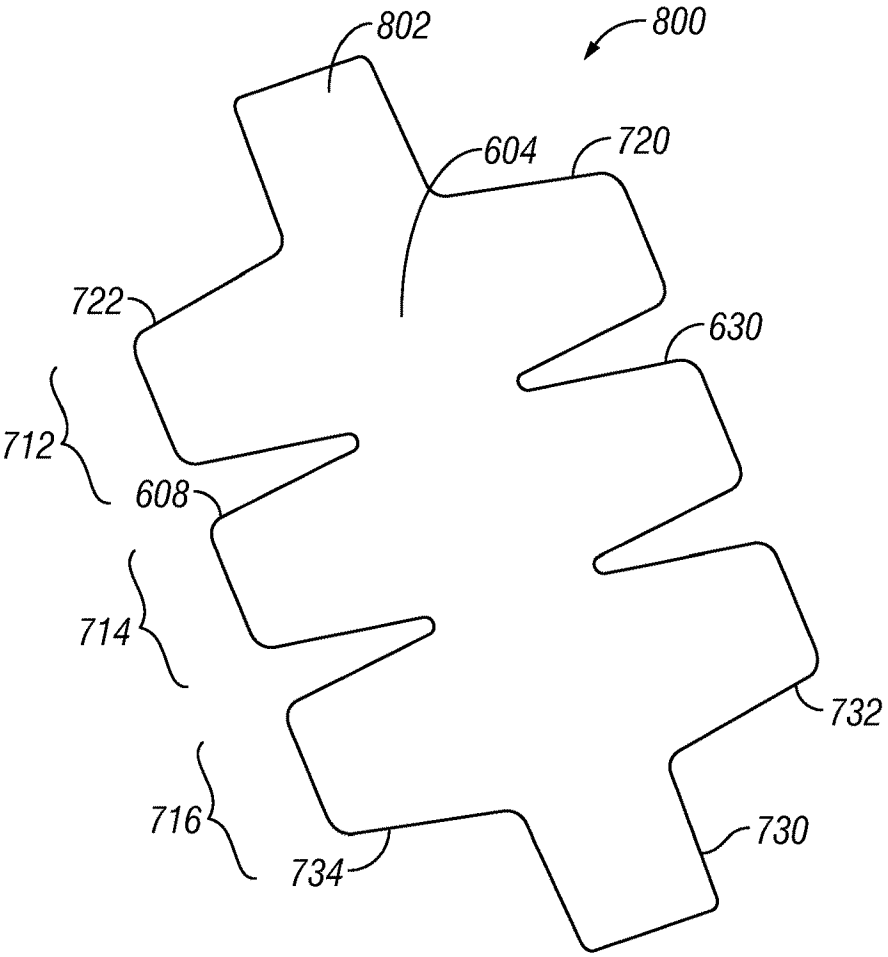
FIG. 8 illustrates a perspective view of a back side of a modular compartment of the packing system of FIGS. 6 and 7, in use for closure, according to certain embodiments.

Referring to FIG. 8, in conjunction with FIGS. 6 and 7, a system 800 includes a backside of the backing 604. The left side flaps 720, 606, 732 are disposed unfolded, and the right side flaps 722, 608 are 734 are also disposed unfolded. The third base flap 730 of the third compartment 716 is similar unfolded. Although not appreciable in FIG. 8, at least certain of the backing 604, and the respective flaps 720, 606, 732, 722, 608, 734 and 730 may be transparent or translucent, include perforations or through ways, or otherwise may allow for visual inspection of articles, such as clothes, accessories, or other items, through the materials thereof when folded to form the compartments 712, 714, 716. Although the flaps 720, 606, 732, 722, 608, 734 and 730 are illustrated as formed or configured of, or connected to, the backing 604, any or all of these may be fixedly or removably connected to the backing 604, as non-exclusive example, by molding, heat joinery, zipper, buttons, hook-and-loop fastener, magnetic strips, adhesive, or otherwise.

Figure 9:
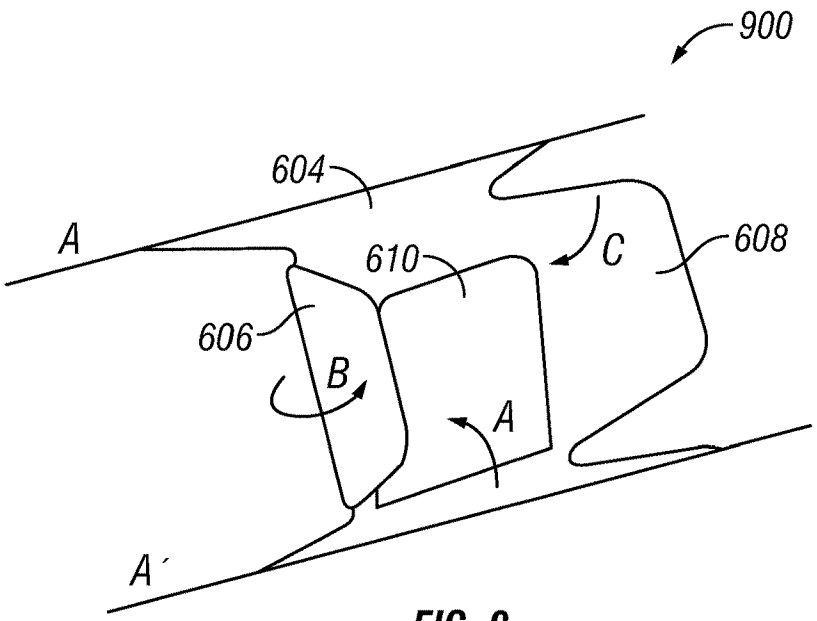
FIG. 9 illustrates a perspective view of a modular compartment of the top side of the packing system of FIGS. 6-8, taken along line A-A', in use with a bottom flap closed for retaining an item (shown in FIG. 12) on one side (e.g., underside) between the top side and the bottom flap, according to certain embodiments.

Referring to FIG. 9, in conjunction with FIG. 6, a compartment system 900 is formed of the backing 604, the base flap 610, the left side flap 606, and the right side flap 608. Initially, the base flap 610 is folded (upwards in direction of arrow A in FIG. 9) towards the backing 604. The left side flap 606 is folded (from left in direction of arrow B in FIG. 9) towards the folded base flap 610 and backing 604. Finally, the right side flap 608 is folded (from right in direction of arrow C in FIG. 9) towards the folded base flap 610, folded left side flap 606, and backing 604.

Figure 10:
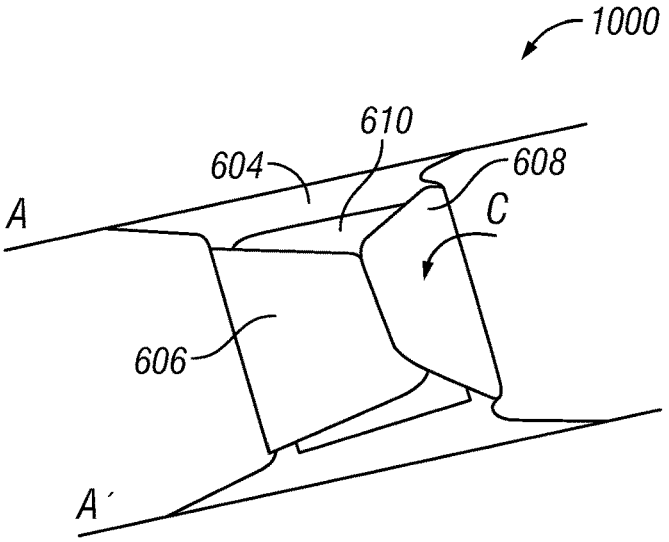
FIG. 10 illustrates a perspective view of the modular compartment of FIG. 9, in use with a bottom flap and left side flap closed for retaining an item on two sides between the top side and the bottom flap and left side flap, according to certain embodiments.

Referring to FIG. 10, in conjunction with FIGS. 9 and 6, a partially formed compartment 1000 of the system 900 includes the base flap 610 and the left side flap 606, each folded towards the backing 604 in that order. The right side flap 608 is folded (from right in direction of arrow C of FIG. 10) towards the folded base flap 610, folded left side flap 606, and backing 604.

Figure 11:
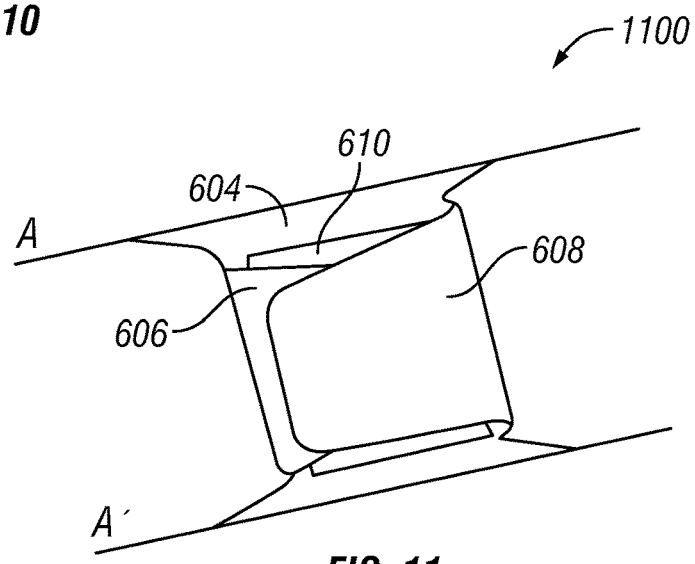
FIG. 11 illustrates a perspective view of the modular compartment of FIG. 10, in use with a bottom flap, left side flap, and a right side flap closed for retaining an item on three sides between the top side and the bottom flap, left side flap and right side flap, according to certain embodiments.

Referring to FIG. 11, in conjunction with FIGS. 9-10 and 6, a complete compartment 1100 of the system 900 includes the base flap 610, the left side flap 606, and the right side flap 608, each folding, in order, towards the backing 604.

Figure 12:
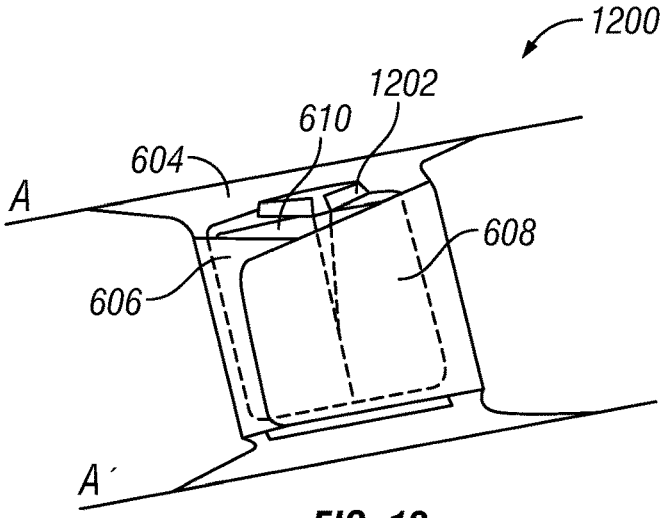
FIG. 12 illustrates a perspective view of the modular compartment of FIG. 11, in use to retain a shirt or other article, according to certain embodiments.

Referring to FIG. 12, a modular compartment 1200 contains an article 1202, as non-exclusive example, a shirt. The base flap 610, the left side flap 606, and the right side flap 608, are each folded, in order, to the backing 604. In use, the right side flap 608, the left side flap 606, and the base flap 610 are initially in unfolded position, and the article 1202 (e.g., shirt) is placed against backing 604 between the flaps 608, 606, 610. The base flap 610 is folded towards the backing 604 to contact the article 1202. The left side flap 606 is folded towards the backing 604 to contact the base flap 610 over the article 1202. The right side flap 608 is folded towards the backing 604 to contact the left side flap 606 layered with the base flap 610 over the article 1202.

In contact of the left side flap 606 to the base flap 610, and in contact of the right side flap 608 to the left side flap 606, respective connectors of the flaps 610, 606, 608 connect the flaps to form a pocket compartment, such as the 612, 614, 616, 712, 714, 716 of FIGS. 6 and 7, respectively. To avoid snag, scrape, or other adverse impact to the article 1202, the base flap 610 includes any connector on a side of the base flap 610 oppositely disposed from the article when the base flap 610 is in folded configuration. The left side flap 606 includes any connector on each side of the left side flap 606, as the left side flap 606 contacts/connects to the base flap 610 in folded configuration, and also contacts/connects to the right side flap 608 in folded configuration. The right side flap 608 includes any connector on a side of the right side flap 608 adjacent the article when the right side flap is in folded configuration to contact/connect to the left side flap 606 in folded configuration.

Figure 13:
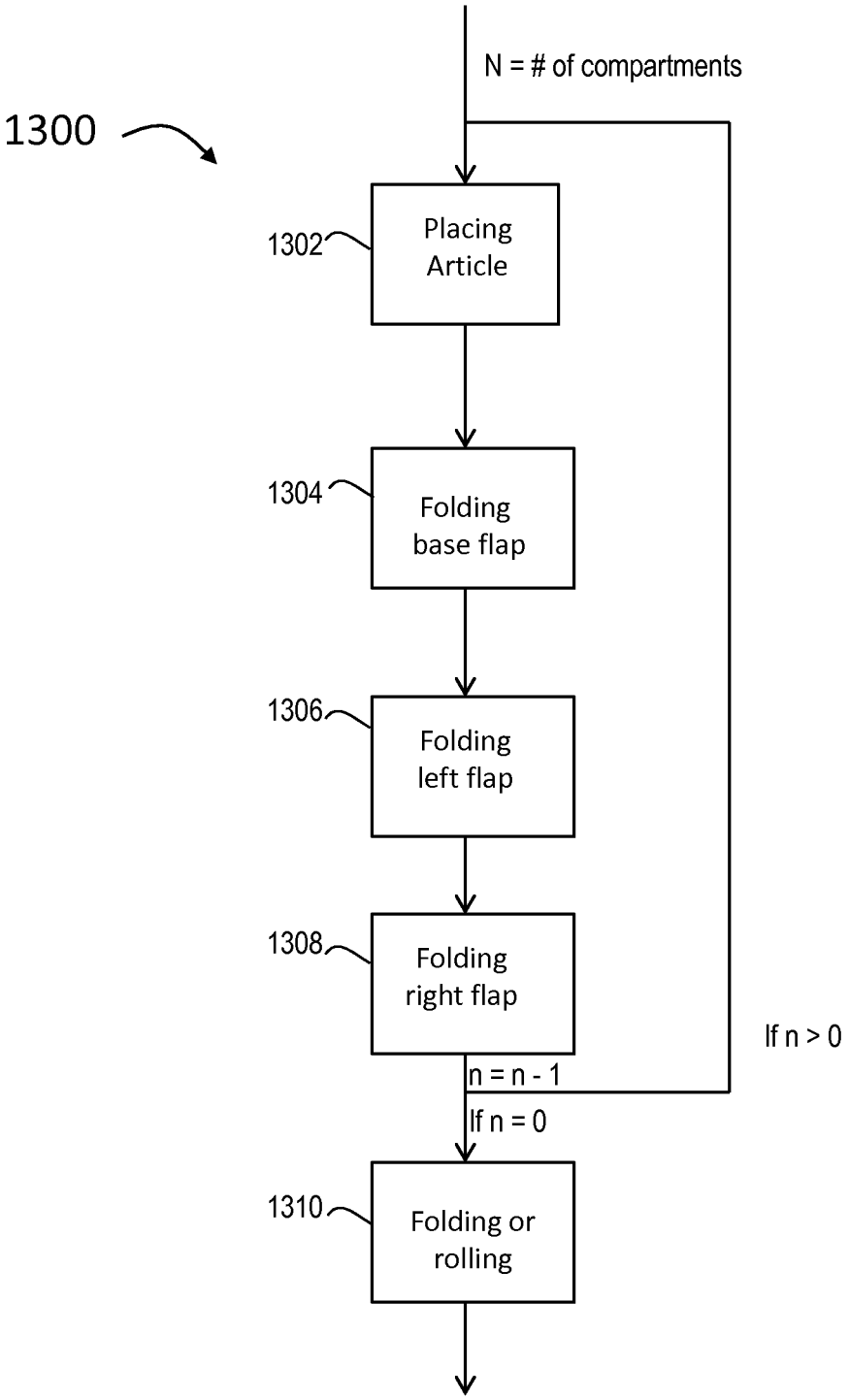
FIG. 13 illustrates a method of use of a packing system, for non-exclusive example, that of FIG. 6, according to certain embodiments.

Referring to FIG. 13, a method 1300 of operation of a system for packing and carrying includes, for one or more compartments (n=number of compartments) placing an article 1302 for packing against a backing and between a base flap, left side flap and right side flap. In a step 1304, a base flap of the applicable compartment is folded against and over the article and backing. The base flap may include a hinge or flex along an edge connecting the base flap to the backing.

On folding the base flap, the left side flap is folded 1306 along a hinge or flex of an edge connecting the left side flap to the backing. The left side flap contacts the base flap, as folded, and connects to the base flap, such as by a removable attachment, as non-exclusive example, hook-and-loop, zipper, magnetic strip, or other.

The right side flap is folded 1308 along a hinge or flex of an edge connecting the right side flap to the backing. The right side flap contacts the left side flap, as folded, and connects to the left side flap. Connectors may include, as nonexclusive example, hook-and-loop, zipper, magnetic strip, or other.

If additional compartments of the system are available for articles, the method 1300 returns to the step 1302 for each next compartment and article. If, however, no additional compartments of the system are available, the method 1300 proceeds to a step of folding or rolling 1310 the backing. In the step 1310, the backing, because flexible, may be folded (e.g., accordion-like or otherwise, according to contained articles), rolled, or similarly compacted.

Figure 1:
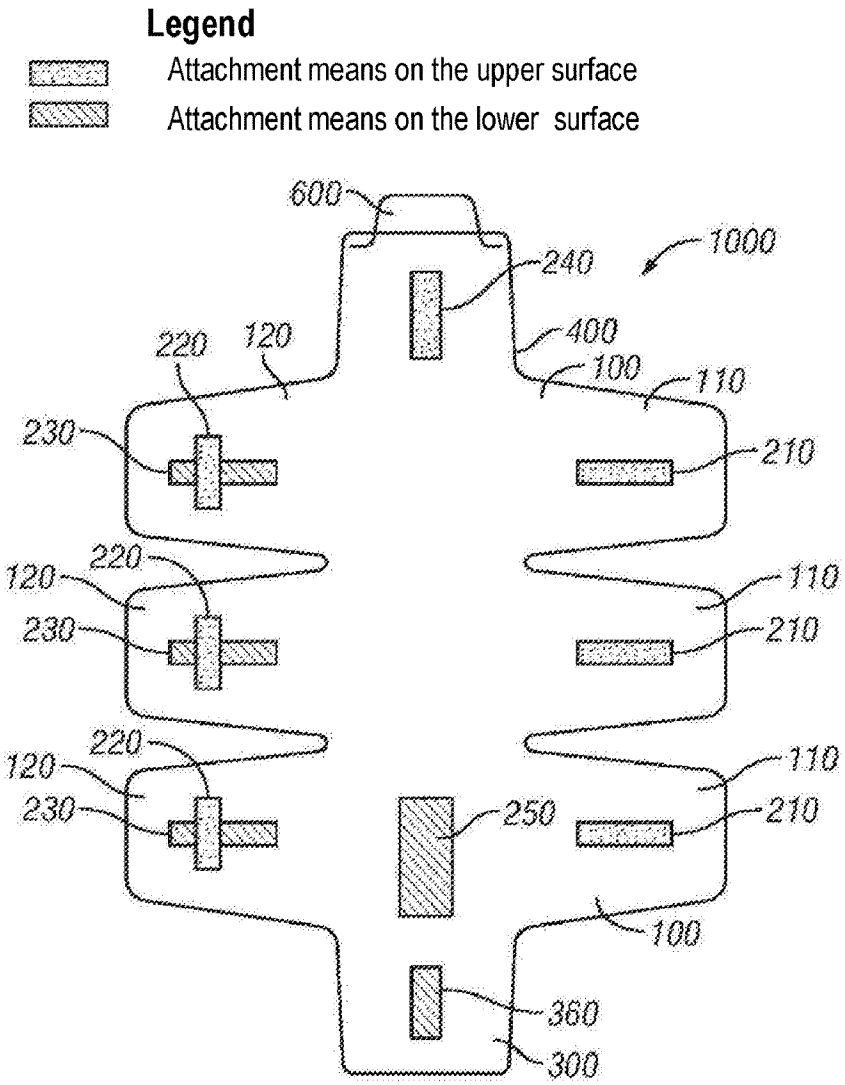
FIG. 1 illustrates an overhead view of a base sheet of a clothing carrier in an unrolled configuration and prior to attachment of the vertical flaps, according to certain embodiments, according to certain embodiments.

Certain non-exclusive example embodiments follow:

As illustrated in FIG. 1, an embodiment of a clothing carrier 1000 comprises transparent base sheet 100 having an upper and lower surface. Base sheet 100 may be flip-flap/Z-fold or accordion shaped such that there are opposing horizontal flaps 110 and 120. At the opposing ends of the base sheet 100 are vertical flaps 300 and 400. Base sheet 100 may be made from any of a number of different flexible plastic sheet materials such as 8 mil (with alternatives of other sizes) polyethylene, polyvinylchloride, polyvinylidene chloride, or similar clear flexible materials. Alternative embodiments may use differing colors of translucent sheet materials of said material for distinction of compartments or for color coding.

The roughly accordion shape of base sheet 100 may be shaped in any of a number of different methods well known in the art such as cutting, stamping and stitching or gluing component sections together.

Each of first horizontal flaps 110 has horizontal flap attachment means 210 on the upper surface of horizontal flap 110. Each of opposing second horizontal flaps 120 has attachment means 220 on the upper surface of each horizontal flap 120 and horizontal attachment means 230 on the lower surface of each horizontal flap 120. The horizontal attachment means 210,220,230 may have opposing hook/ loop patch configurations (e.g. Velcro™) so that opposing patches can be fastened together by pressing one opposing patch against the other.

Figure 4:
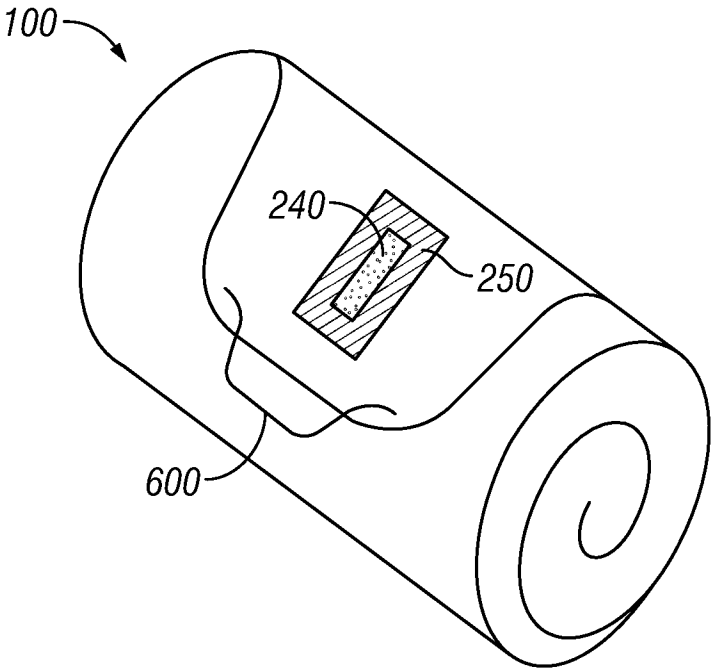
FIG. 4 illustrates the clothing carrier of FIGS. 1-3 in a "Swiss roll" configuration (Note: To simplify FIG. 4, the clothing and some of the clothes compartment attachment means are not expressly shown), according to certain embodiments.

Vertical flap 300 has first Swiss roll attachment means 240 on its upper surface and on the lower surface of the main body of base sheet 100 is second Swiss roll attachment means 250 that is intended to be attached to attachment means 240 when the clothing carrier is rolled into its "swiss roll" configuration (See FIG. 4). The Swiss roll attachment means 240 and 250 may have opposing hook/loop patch configurations (e.g. Velcro™) so that the opposing patches can be fastened together by pressing one opposing patch against the other. In certain embodiments, similar attachment means allow a flip-flap/Z-fold or accordion-like configuration to be secured in arrangement.

The lower surface of vertical flap 300 has attachment means 360 that is intended to be used to form the lower clothing compartment on the apparatus. The various attachment means coupled to base sheet 100 may be any of a number of different attachment means such as buttons, zippers, snaps, compression fits and so forth. However, it may be preferred that the attachment means are of a hook and loop type also known by the trade name Velcro™.

Vertical flap 400 may also have hanger 600 that allows clothing carrier 1000 to be hung from a hook or hanger. Hanger 600 may be a strap, cord, wire, hanger and so forth and it may be attached to base sheet 100 may by any of a number of different ways including taping, gluing, hot molding, and so forth.

Figure 2:
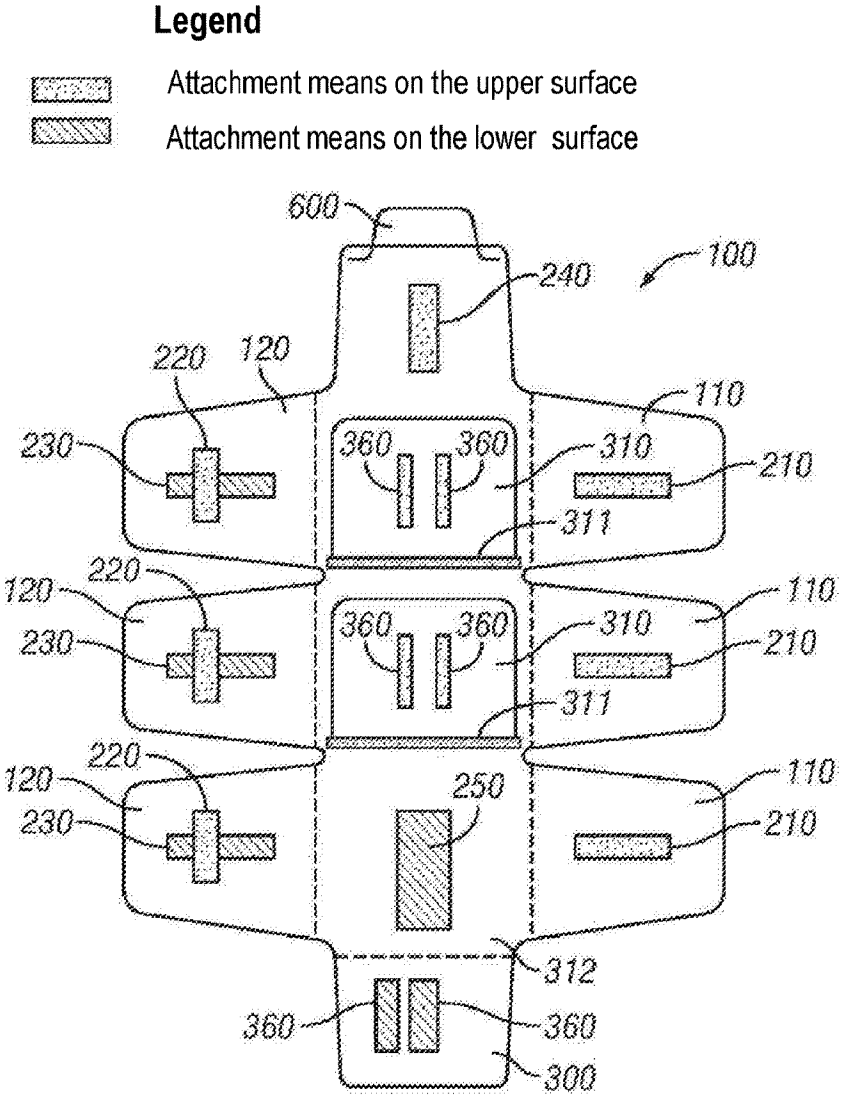
FIG. 2 illustrates the clothing carrier of FIG. 1 after the vertical flaps have been attached to the base sheet, according to certain embodiments.

FIG. 2 shows base sheet 100 after two vertical flaps 310 have been attached to the upper surface of base sheet 100 using vertical flap attachment means 311. Vertical flap 310 can be attached to the upper surface of base sheet 100 using any of a number of different attachment mechanisms such as hot stamping, gluing, tacking, stitching and so forth. It is also possible that vertical flaps 310 can be an integral part of base sheet 100. Vertical flaps 310 may contain one or more vertical flap attachment mechanisms 360 on the top surface of 310. In the configuration shown in FIG. 2, vertical flap 300 is indeed an integral part of carrier 100 and it is intended to be folded upward along fold line 312 to form the lower clothing compartment (i.e. the compartment opposite of hanger 600). It is also possible that the lower clothing compartment is also formed using another vertical flap 310 that is attached over integral vertical flap 300 (not expressly shown).

Figure 3:
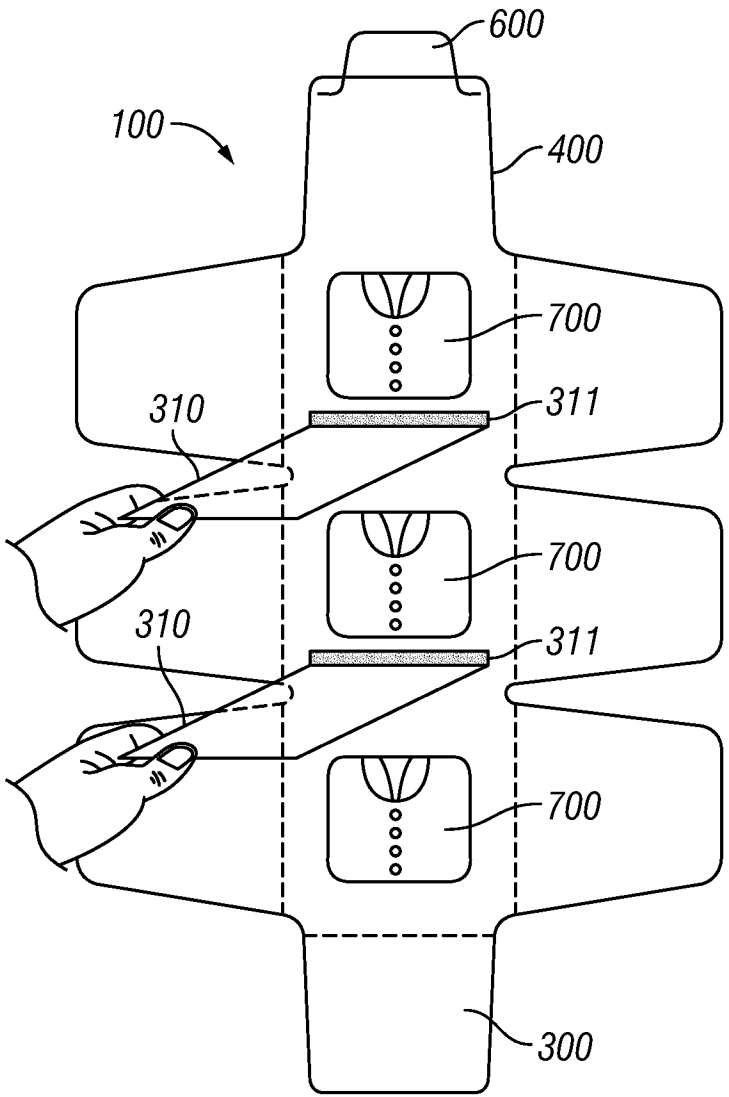
FIG. 3 illustrates the clothing carrier of FIGS. 1-2 with vertical flaps being held above the base sheet and articles of clothing placed in a position to be covered by the vertical and horizontal flaps (Note: To simplify FIG. 3, the various attachment means are not expressly shown), according to certain embodiments.

FIG. 3 shows the carrier of FIG. 2 with folded clothing 700 placed on the top surface of base sheet 100. To place the clothing in a position that it can be snugly fitted into a clothing compartment it is necessary to lift vertical flaps 310 off the surface of base sheet 100 and then place the clothing 700 in a central position underneath of the raised vertical flaps 310. (To simplify the drawing in FIG. 3, the various attachment mechanisms shown in FIG. 1 are not shown in FIG. 2).

In the configuration shown in FIGS. 1-3, the clothing compartments are made using the following steps.

Step 1: Put clothing 700 on the top surface of base sheet 100 directly underneath of vertical flap 310 (and directly below vertical flap 300 after flap 300 has been folded over at the opposite end of carrier 1000 from hanger 600). This leaves vertical flap attachment mechanisms 360 on the top surface of vertical flap and on the opposite side of the said flaps from clothing 700.

Step 2: Fold horizontal flap 120 over vertical flap 310 and clothing 700 such that attachment mechanism 220 detachably attaches to vertical flap attachment mechanism 360 Using multiple attachment mechanisms 360 (e.g. patches) or attachment mechanisms with large geometries allows for varying amounts of clothing 700 in the compartment since the snugness can be varied depending on using varying configurations of the attachment mechanisms. Because horizontal flap 120 has been folded over, attachment mechanism 230 is now facing upward.

Step 3: Fold horizontal flap 110 over previously folded horizontal flap 120 and then snugly attach to flap 120 using attachment mechanism 210 to attach to attachment mechanism 230.

These steps can be repeated with each of the compartments. In the lower compartment it is vertical flap 300 that is folded over clothing 700 in Step 1.

By using three flaps whose snugness against clothing 700 can be varied by using different configurations of attachment mechanisms it is possible for a user to have variable compartment volumes yet snugly place different amounts of clothing in the compartments that have been made by folding and detachably attaching the vertical and horizontal flaps. After the clothing is snugly in the compartments, should a user desire carrier 1000 can be hung vertically from a hook or door by using hanger 600 at the apex of carrier 1000.

More typically, a user will simply proceed to Step 4 in the process of packing clothes 700.

Step 4. The user simply rolls base sheet 100 along with clothes 700 into a Swiss roll configuration starting at the end of carrier 100 that is opposite hanger 600. As depicted in FIG. 4, carrier 1000 is designed to be rolled from the flat configuration shown in FIGS. 1-3 to the rolled configuration shown in FIG. 4.

This is achieved by rolling the base sheet 100 inwardly on itself until carrier 1000 forms the rolled configuration shown in FIG. 4.

Step 5: To keep carrier 1000 in a Swiss roll configuration the user detachably attaches Swiss roll attachment mechanism 250 to opposing Swiss roll attachment mechanism 240. By making attachment mechanism 250 and attachment mechanism 240 relatively large (elongated patches along the length of base sheet 100) it is possible to use these attachment mechanisms for Swiss rolls of various diameters (i.e. different amounts of clothing 700). In the rolled configuration, the patch of hook/loop fastener material 250 is pressed against the opposing patch of hook/loop fastener material 240 that assists in holding carrier 1000 in the rolled configuration and prevents lateral movement of the top end 300 relative to the bottom end 400.

Base sheet 100 may be made from a variety of flexible plastic materials that are known to naturally hold a negative electrostatic charge, such as polyvinyl chloride (PVC) or polyethylene. On the other hand, many types of clothing have a natural tendency to accumulate a positive electrostatic charge. Obviously, the electrostatic attraction created between the clothing 700 in carrier 1000 and the plastic material of base sheet 100 itself may assist in holding the clothing against base sheet 100 and lessen the likelihood of bunching up and then wrinkling or creasing. This is especially true when one considers the effect of both the electrostatic attraction and the fact that the adjustable compartments of the subject invention allow for very snug packing of the clothing.

In one embodiment it may be desirable to carry the Swiss roll configuration using a shoulder strap (not expressly shown in the drawings). This can be easily accomplished by laying a shoulder strap or straps near the middle of the unrolled carrier 1000 prior to Step 4 supra, so that when carrier 1000 is rolled into the Swiss roll configuration in Step 4 the shoulder strap is detachably attached to carrier 1000 until it is unrolled at the destination. In this way the rolled carrier 1000 can be carried while cycling, walking or during other activities requiring use of both hands.

A variety of different pockets, containers, hooks, and attachment mechanisms not expressly shown herein may also be added to the configuration of carrier 1000 as shown in FIGS. 1-4 without deviating from the scope of the invention.

Carrier 1000 may be imprinted with indicia, such as the user's initials, company name or for advertising or promotional matter.

In yet another embodiment (not expressly shown) it is possible to combine two or three modular carriers as depicted in FIGS. 1-4 into a combined double or triple carrier by using attachment means on the sides of the carrier 1000 so that one such carrier can be placed side by side with another such carrier and then attached to one another (not expressly shown). In such a side-by-side configuration it may be desirable not to roll the entire apparatus into a Swiss roll configuration but instead to fold one of the apparatus on top of die other in a flip/flop motion laying one layer over the other or in a Z fold pattern (once again not expressly shown).

Figure 5:
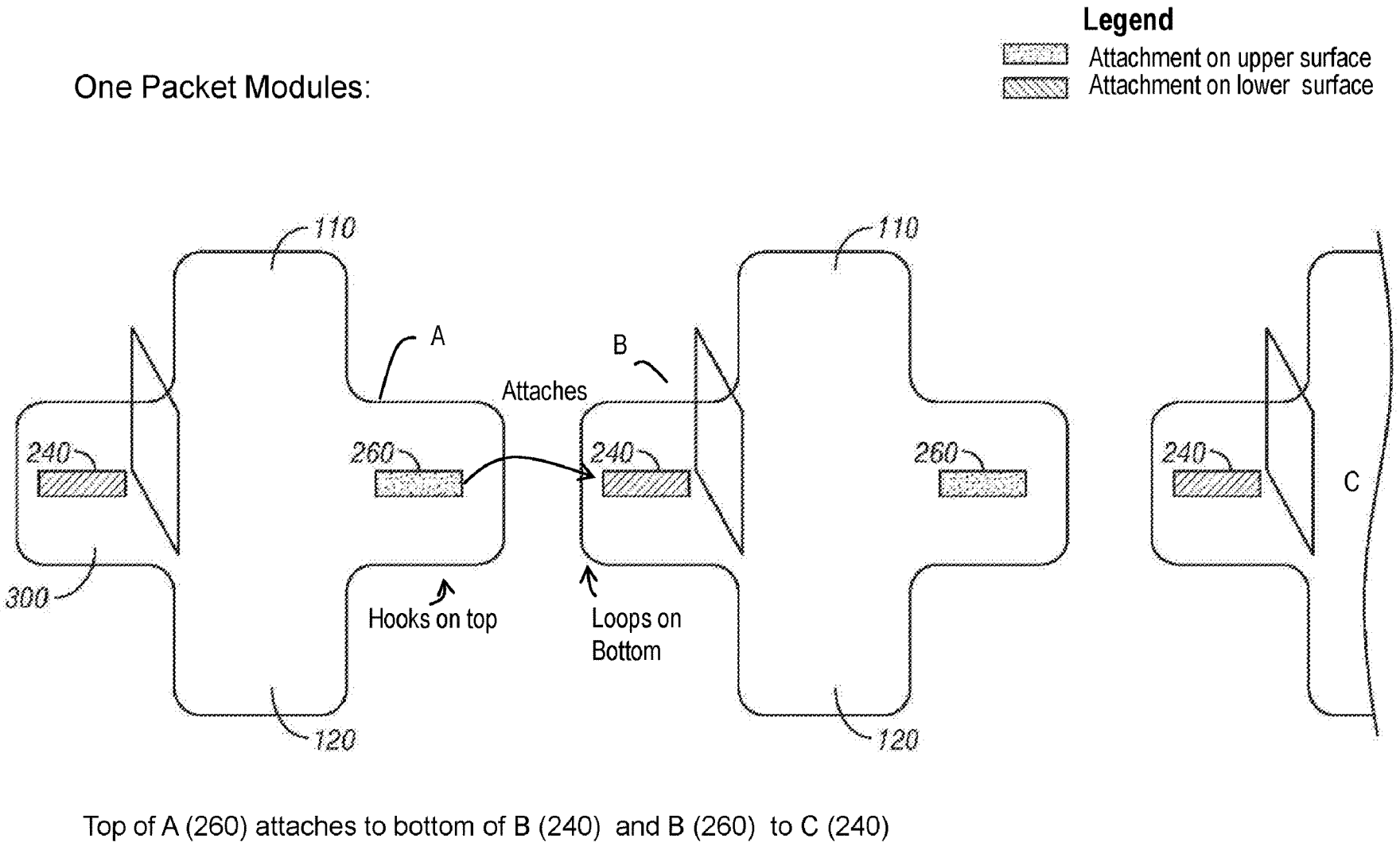
FIG. 5 depicts an alternative of modular clothing compartments, according to certain embodiments.

In yet another embodiment as shown in FIG. 5, the individual clothing compartments set forth in FIGS. 1-4 may be modular/separate from one another and then attached using modular attachment means. In other embodiments, an additional flap may be included that folds downward over the compartment formed by the other flaps.

A variety of alternatives are possible in the foregoing embodiments. For example, although focus has been on attachment means of opposing hook-and-loop type fasteners, such as that available under the trade mark Velcro™, detachable attachment of various portions of the carrier may be effected by way of a number of different attachment means such as buttons, snaps, zippers, compression fittings and so forth.

Although particular units, modules, or other elements are illustrated as unitary (or not) in the embodiments, it is contemplated that certain of those units, modules or other elements may be included in whole or part as features that interact with or incorporate other units, modules or elements (including, for example, third party parts or elements) or that are combined in whole or part with other units, modules or elements.

In the foregoing, the invention has been described with reference to specific embodiments. One of ordinary skill in the art will appreciate, however, that various modifications, substitutions, deletions, and additions can be made without departing from the scope of the invention. Accordingly, the specification and figures are to be regarded in an illustrative rather than a restrictive sense, and all such modifications substitutions, deletions, and additions are intended to be included within the scope of the invention. Any benefits, advantages, or solutions to problems that may have been described above with regard to specific embodiments, as well as device(s), connection(s), step(s) and element(s) that may cause any benefit, advantage, or solution to occur or become more pronounced, are not to be construed as a critical, required, or essential feature or element.

What is claimed is:

1. A system for packing, comprising:

a backing;

a flexible base flap connected to the backing for folding against the backing;

a flexible left side flap connected to the backing;

a flexible right side flap connected to the backing;

wherein either of the flexible left side flap and the flexible right side flap folded for folding against the flexible base flap as folded to the backing, and the other of the flexible left side flap and the flexible right side flap for folding against either of the flexible right side flap and the flexible left side flap, respectively, folded against the flexible base flap;

wherein the backing and the flexible base flap, the flexible left side flap and the flexible right side flap when folded form a unitary compartment of variable volume according to selective folding of each of the flexible base flap, the flexible left side flap and the flexible right side flap;

a connector fixed to a side of the flexible base flap opposing the backing when the flexible base flap is folded against the backing;

a mating connector fixed to a side of the flexible left side flap for attachment to the connector when the flexible left side flap is selectively folded against the flexible base flap for desired volume of the compartment according to selective folding of each of the flexible base flap, the flexible left side flap and the flexible right side flap;

a second connector fixed to another side of the flexible left side flap;

a second mating connector fixed to a side of the flexible right side flap for attachment to the second connector when the flexible right side flap is selectively folded against the flexible left side flap for desired volume of the compartment according to selective folding of each of the flexible base flap, the flexible left side flap and the flexible right side flap;

wherein the backing, together with the flexible base flap, the flexible right side flap, and the flexible left side flap, as each selectively folded, forms a pocket for containing an article of variable volume according to selective folding of each of the flexible base flap, the flexible left side flap and the flexible right side flap; and the backing provides more than one unitized compartment, each respective compartment of a respective flexible base flap, a respective flexible left side flap and a respective flexible right side flap, each compartment a respective pocket of variable volume according to selective folding of the respective flexible base flap, the respective flexible left side flap and the respective flexible right side flap, for containing a respective article.

2. The system of claim 1, wherein the backing is flexible and together with respective pockets containing articles, is rollable.

3. The system of claim 2, further comprising:

a shoulder strap rolled into the backing, the shoulder strap provides a handle for carrying the backing as rolled.

* * * * *